United States Patent [19]

Hodge

[11] Patent Number: 5,016,735

[45] Date of Patent: May 21, 1991

[54] SCAFFOLD PLANKING STABILIZER

[76] Inventor: Todd D. Hodge, 630 New Rd., Raleigh, N.C. 27608

[21] Appl. No.: 472,127

[22] Filed: Jan. 30, 1990

[51] Int. Cl.[5] ..... E04G 5/08

[52] U.S. Cl. ..... 182/223; 182/119

[58] Field of Search ..... 182/222, 223, 185, 119

[56] References Cited

U.S. PATENT DOCUMENTS

| | | | |
|---|---|---|---|
| 936,007 | 10/1909 | Mauborgne | 182/185 |
| 1,774,268 | 8/1930 | Harding | 182/223 |
| 2,569,450 | 10/1951 | Bouton . | |
| 3,854,552 | 12/1974 | Kensrue . | |
| 4,020,921 | 5/1977 | Rawlings . | |
| 4,121,690 | 2/1980 | Rawlings et al. . | |
| 4,187,929 | 2/1980 | Cyr . | |
| 4,340,130 | 7/1982 | Payne et al. . | |
| 4,391,348 | 7/1983 | Rieland . | |
| 4,534,448 | 8/1985 | Trainer . | |
| 4,844,200 | 7/1989 | Flint, Jr. . | |

FOREIGN PATENT DOCUMENTS

| | | | |
|---|---|---|---|
| 775189 | 5/1957 | United Kingdom | 182/222 |

*Primary Examiner*—Reinaldo P. Machado

*Attorney, Agent, or Firm*—Rosenthal & Putterman

[57] ABSTRACT

A connector for maintaining the floor elements of a scaffold in a fixed spaced relation is disclosed. The connector comprises a plurality of independent sleeves, each of the sleeves being adapted to receive one of a plurality of floor elements. The sleeves are rigidly interconnected. Each sleeve includes an opening that is adapted to receive a nail so that the sleeve and the respective floor elements may be connected.

5 Claims, 2 Drawing Sheets

SCAFFOLD PLANKING STABILIZER

FIELD OF THE INVENTION

This invention relates generally to the field of scaffolding and more specifically to a bracket for retaining the position of scaffold floor boards.

BACKGROUND OF THE INVENTION

Scaffolding is employed extensively in the building industry to form elevated work platforms that are used both on the interior and the exterior of construction projects so that tradesmen can perform various tasks, such as carpentry, welding, framing, and painting. It is, thus, of primary importance that scaffolds, and especially the scaffold flooring, be safe and secure to protect both the workmen on the platform and the laborers below.

In general, scaffolds include tubular metal end frames connected together by metal cross braces to form a rectangular unit. According to current practice, wooden floor planks are then laid side by side supported on opposite ends by the end frames to provide an elevated walkway. It is common practice to make the length of these floor boards longer than the space between the end frames. This is undesirable as the boards can shift position and fall from the platform and also because the boards are not mounted for maximum load bearing capacity. It is also common for tradesmen to obtain a number of boards commonly known as 2×4's and to nail them together with short pieces of 2×4 trimmings between the longer boards. This solution is less than optimal as it is not uncommon for the boards to separate from each other, thus, causing a potentially dangerous situation. In addition, once a scaffold floor such as this has been constructed, it is common practice for the tradesmen to transport it to a number of job sites. General contractors will often regard this as stealing and in addition, this causes a roadway hazard as often fourteen foot long boards will protrude beyond several feet of the tailgate of a pick-up truck. Another drawback to this system resides in the fact that often times constructing the scaffold flooring as described renders the wood unsuitable for use elsewhere on the job site.

Various attempts have been made to overcome the foregoing drawbacks and deficiencies. For example, the U.S. Pat. No. 3,854,552 to Kensrue discloses a scaffold planking clamp that includes separate clamping devices for the ends of each plank. Each clamping device includes a clamping bar on the underside of the plank that is arranged to engage the scaffold cross-member. Under the surface of the planking is a manually operable screw and nut means that activates the plank edge engaging members carried by the nut so as to force them to clampingly coact with the clamping bar to securely anchor the plank to the cross-member. This device, while accomplishing the objective of securing the planking to the scaffolding is less then an ideal solution as it is a relatively complex mechanism and would, therefore, be time consuming to set-up at the job site.

U.S. Pat. No. 2,569,450 to Bouton discloses a clamp which may be employed for securing together boards forming the floor of a scaffold to form a floor thereon. The clamp is adapted to secure together in a side by side relation, a plurality of boards forming the scaffold floor. The clamp comprises an upper bar and a lower bar that are hinged together at one end. At the other end is a clamping means 14 for drawing the bars into a clamped position. The clamping means may be a rigid collar slidable along the bars with a clamping bolt threaded in the lower section thereof and which is screwed into engagement with the underside of the bar 11. As the clamping bolt is tightened, the collar is drawn into firm engagement with the upper side of the bar and the two bars are moved to clamp the planks between them. The Bouton clamp is also less than ideal as it is a relatively complex device with a number of moving parts which is, therefore, somewhat difficult to produce.

U.S. Pat. No. 4,187,929 to Cyr discloses a scaffold stabilizer clamp which comprises an elongate flat steel strip which is formed into a C-shape so as to have an upper plate member and a lower plate member. The plate members are provided with a correspondingly located and spaced pairs of holes, each pair which is adapted to receive a bolt and wing nut to tighten the ends of the plate members after wooden planks of the desired width are inserted between the plate members to form the platform of the scaffold. This clamp is also not without its drawbacks as it requires a wing nut and bolt which may easily be lost in order to be operable.

In view of the foregoing, it is an object of the present invention to provide a scaffold flooring clamp that is safe.

Another object of the present invention is to provide a scaffold flooring clamp that is easy to use and is easily transportable.

A further object of the present invention is to provide a scaffold flooring clamp in which the flooring lumber remains usable after the scaffold has been dismantled.

A still further object is to provide a scaffold flooring clamp that is simple to manufacture.

A still further object is to provide a scaffold bracket that uses the most common and available type and size of lumber on any residential or commercial job site.

Yet another object is to provide a scaffold flooring in which the floor boards are mounted for maximum load bearing capacity.

Yet another object is to provide a scaffold flooring clamp without moving parts and which is self-contained.

SUMMARY OF THE INVENTION

In accordance with the present invention, there is provided a connector for maintaining the floor elements of a scaffold in a fixed spaced relation. The connector comprises a plurality of sleeves each of which is adapted to receive a respective one of a plurality of floor elements. The connector includes means for rigidly interconnecting the sleeves and means for attaching the sleeves to the respective floor elements are formed in each of the sleeves.

BRIEF DESCRIPTION OF THE DRAWINGS

Some of the objects of the invention having been stated, other objects will appear as the description proceeds when taken in connection with the accompanying drawings in which.

DETAILED DESCRIPTION OF THE PREFERRED EMBODIMENT

While the present invention will be described more fully hereinafter with reference to the accompanying drawings, in which a particular embodiment is shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

Figure 1:
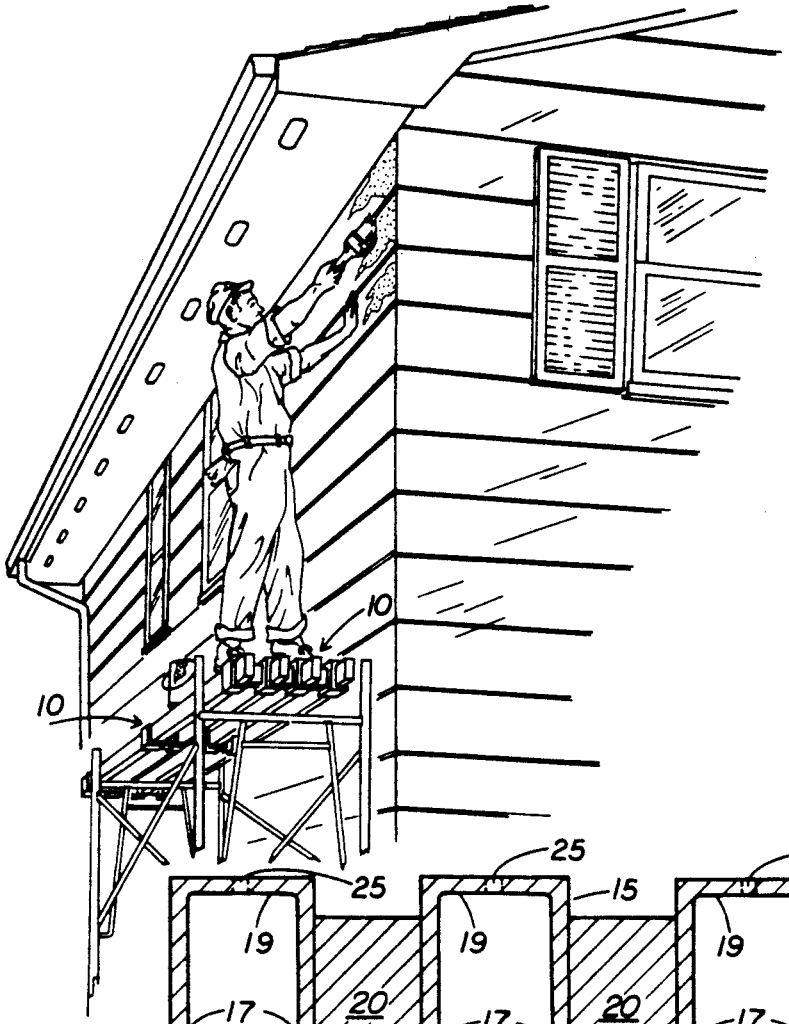
FIG. 1 is a perspective view of a portion of a scaffold embodying the scaffold planking stabilizer of the present invention constructed alongside a residential structure and illustrating a tradesman working thereon.

Referring more particularly to the drawings, a scaffold planking stabilizer which embodies the features of the present invention is generally indicated at 10. Generally, scaffolds comprise tubular metal end frames connected together by cross braces to form a rectangular unit as shown in FIG. 1. Wooden floor planks lay side by side within the scaffold planking stabilizer 10 and are supported on opposite ends by the end frames to provide an elevated walkway.

Figure 2:
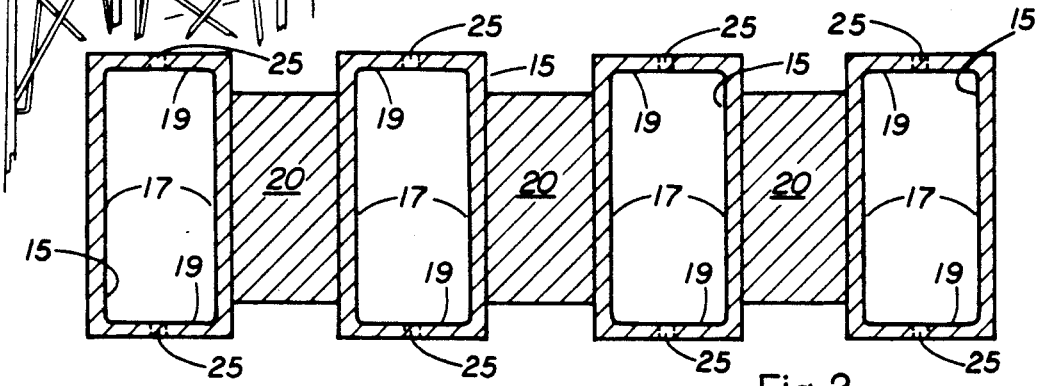
FIG. 2 is a side view of the scaffold planking stabilizer of the present invention.
Figure 3:
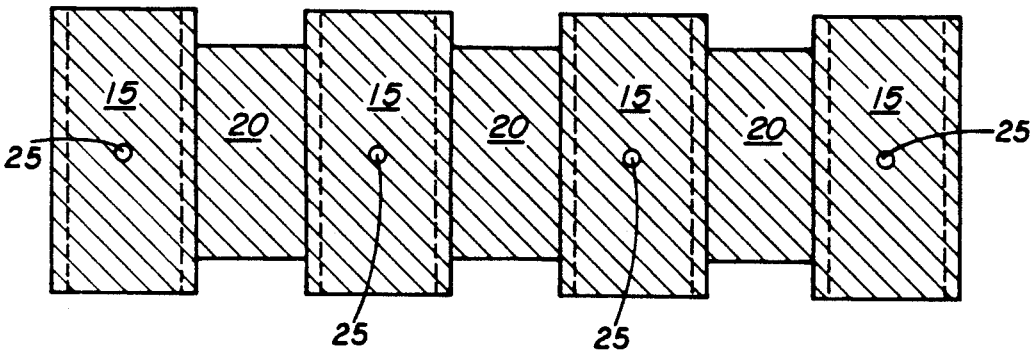
FIG. 3 is a plan view of the scaffold planking stabilizer of the present invention.
Figure 4:
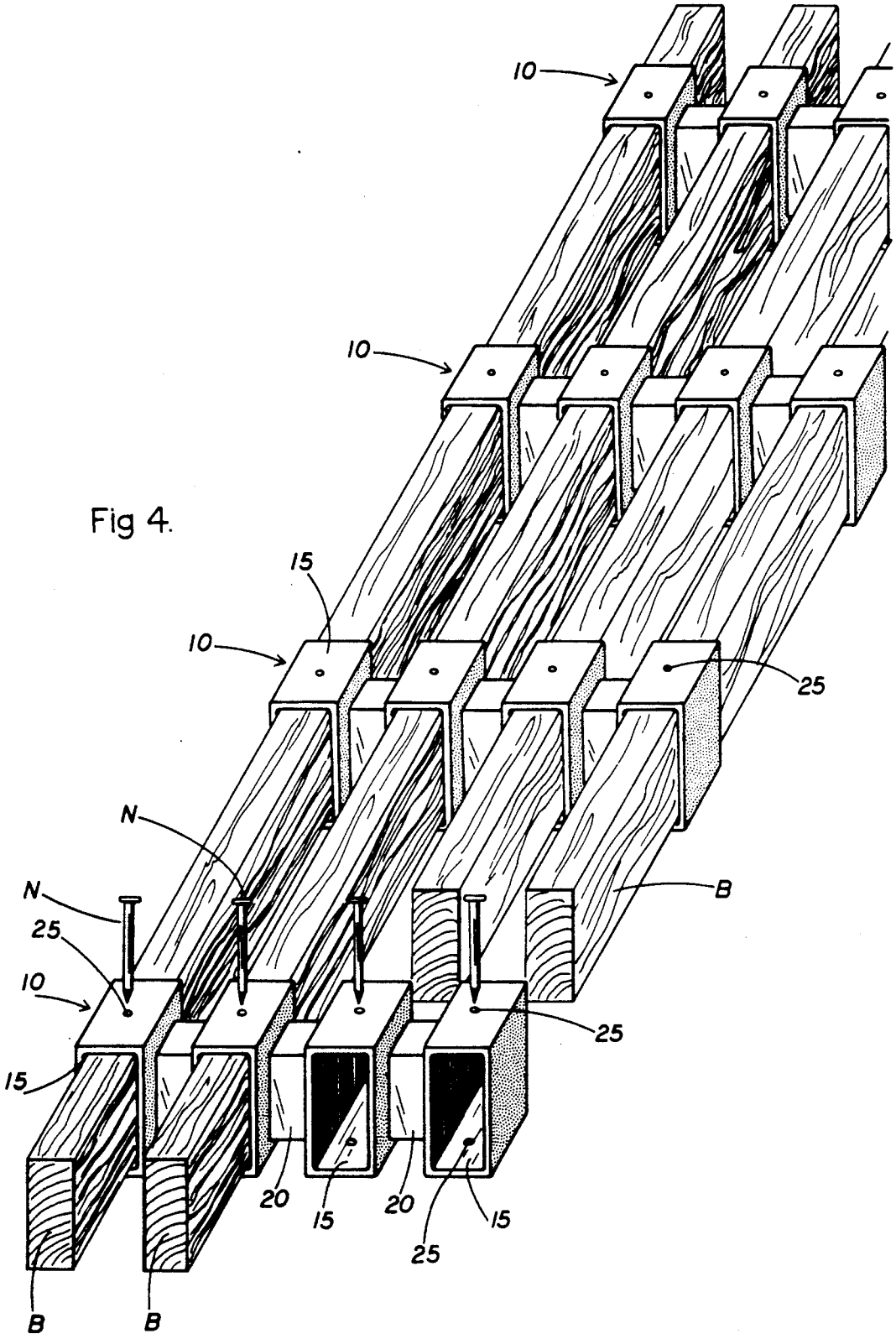
FIG. 4 is a perspective view of a plurality of the scaffold planking stabilizers of the present invention with the wooden floor elements being inserted in to the sleeves.

Referring now to FIGS. 2 through 4, the scaffold planking stabilizer 10 is therein disclosed in detail. The scaffold planking stabilizer comprises a plurality of independent sleeves 15, means for rigidly interconnecting the sleeves 20 and a means 25 for attaching the sleeves to the floor elements.

Each of the plurality of independent sleeves 15 is adapted to receive a respective one of a plurality of floor elements such as elongate wooden floor boards B. Each sleeve defines an opening having opposite side walls 17 and opposite end walls 19 and is adapted to receive a wooden floor board B. The most commonly available lumber at most job sites is the so called "2×4" which is in reality 1.50 inch by 3.50 inch and ranges in length from 8 feet to 16 feet. Accordingly, in the preferred embodiment of the invention, the sleeves 15 are dimensioned approximately one eighth inch larger than the boards that are adapted to fit within the sleeve to allow for slight dimensional differences between boards as well as for expansion and contraction caused by changes in the weather and/or drying out of the boards over time. In the illustrated embodiment each sleeve opening is, therefore, 1.625 inch by 3.625 inch by 4.00 inches in length and the sleeve has a thickness of approximately 0.25 inch.

The scaffold planking stabilizer 10 also includes spacer means 20 for rigidly interconnecting the sleeves connected to the side walls 17 of the sleeves 15. In the illustrated embodiment the means 20 for rigidly interconnecting the sleeves comprises a solid, substantially square solid block of suitable material positioned between adjacent side walls 17 of each sleeve. This means 20 enables the wooden floor elements to be maintained in a spaced apart relation about one and one-half inch apart. The reader will note that the floor elements are inserted into the respective slots so that they rest on their sides as opposed to lying flat as has been the case with prior art devices. When mounted in this manner, the floor elements not only form a work platform, but are also used to the advantage of their properties as structural members, thereby forming a strong yet relatively lightweight scaffold floor. Generally, the means 20 for rigidly interconnecting the sleeves connects the sleeves 15 such that they are in substantial linear alignment.

Each sleeve also includes means 25 for attaching the sleeves 15 to the respective floor elements B associated with at least some of the end walls 19 of the sleeves 15 and in the illustrated embodiment comprises an opening 25 in the end walls 19 of each sleeve 15 through which a nail N may be driven into each of the floor elements B.

In order to assemble a scaffold floor employing the scaffold planking stabilizer of the present invention, it is only necessary to insert the floor elements B into the respective sleeve 15 and to nail it in place (as best shown in FIG. 4). The reader will note that the stabilizer 10 rests on the outer portion of the scaffold end frames and, therefore, provides an additional margin of safety as it is virtually impossible for the floor elements B to slide off of the scaffold (see FIG. 1). When the work is complete and it is desired to disassemble the scaffold flooring it is only necessary to remove the nails and to slide the floor elements B out of the scaffold planking stabilizer 10. The stabilizer may then be easily transported to the next job site where the tradesman will again find a ready supply of lumber from which to quickly reconstruct the scaffold floor.

It is intended that scaffold planking stabilizer of the present invention be formed out of cast aluminum, steel, other suitable materials such as high strength plastics which may be reinforced with fibers such as boron or other composite materials to increase its strength. The reader will also note that the dimensions of the scaffold planking stabilizer 10 may easily be modified to accept floor boards of any dimension such as, for example, 2 inch by 6 inch, or 2 inch by 8 inch to accommodate heavier loads. In addition, it is contemplated that one stabilizer will be used approximately for every four feet of flooring, but the user may vary this to fit his particular needs.

In addition, it is contemplated that the width of the means 20 for rigidly interconnecting the sleeves will be slightly wider than the width of the floor elements B. This enables separate scaffold flooring sections to be laid end to end with the end portions of the respective floor elements B being interleaved between the interconnecting means 20 thereby forming a continuous substantially linear work platform.

The foregoing embodiments and examples are to be considered illustrative, rather than restrictive of the invention, and those modifications which come within the meaning and range of equivalence of the claims are to be included therein.

That which is claimed is:

1. A connector for mounting the floor elements of a scaffold in a fixed spaced relation that utilizes to advantage the structural properties of the floor elements and comprising:

a plurality of independent sleeves, each of said sleeves defining an opening having opposite side walls and opposite end walls and being adapted to receive a respective one of a plurality of similarly sized floor elements;

spacer means for rigidly interconnecting said independent sleeves connected to the side walls of said sleeves;

said plurality of sleeves and said spacer means for rigidly interconnecting said sleeves being of unitary construction; and means for attaching said sleeves to the respective floor elements associated with at least some of the end walls of said sleeves.

2. The connector according to claim 1 wherein each of said sleeves defines a rectangular opening that is approximately 1.625 inch by 3.625 inch.

3. The connector according to claim 1 wherein said spacer means for rigidly interconnecting said independent sleeves connects said sleeves such that they are in substantial linear alignment.

4. The connector according to claim 1 wherein the width of said spacer means for rigidly interconnecting said independent sleeves is greater than the width of a corresponding floor element thereby enabling separate scaffold flooring sections to be laid end to end with the end portions of the respective floor elements being interleaved between corresponding opposing interconnecting means.

5. The connector according to claim 1 wherein said respective independent sleeves are in orientation to receive a respective one of a plurality of similar sized floor elements in orientation for maximum load bearing capacity.

* * * * *